US005857872A

United States Patent [19]

Tettinger

[11] Patent Number: 5,857,872

[45] Date of Patent: Jan. 12, 1999

[54] CONNECTOR ASSEMBLY FOR MOUNTING A COAXIAL PLUG TO A COAXIAL CABLE

[75] Inventor: Mathias Tettinger, Unterschleissheim, Germany

[73] Assignee: Rosenberger Hochfrequenztechnik GmbH & Co., Tittmoning, Germany

[21] Appl. No.: 807,743

[22] Filed: Feb. 27, 1997

[30] Foreign Application Priority Data

Feb. 27, 1996 [DE] Germany ..... 296 03 571.8

[51] Int. Cl.[6] ..... H01R 17/04

[52] U.S. Cl. ..... 439/584; 439/805

[58] Field of Search ..... 439/578, 583, 439/584, 429, 805

[56] References Cited

U.S. PATENT DOCUMENTS

| | | | |
|---|---|---|---|
| 3,498,647 | 3/1970 | Schroder . | |
| 3,501,737 | 3/1970 | Harris et al. . | |
| 4,046,451 | 9/1977 | Juds et al. | 439/583 |
| 4,973,265 | 11/1990 | Heeren . | |
| 5,167,533 | 12/1992 | Rauwolf . | |
| 5,284,449 | 2/1994 | Vaccaro . | |
| 5,334,051 | 8/1994 | Devine et al. . | |
| 5,435,745 | 7/1995 | Booth | 439/583 |
| 5,518,420 | 5/1996 | Pitschi | 439/578 |

*Primary Examiner*—Neil Abrams
*Assistant Examiner*—Brian J. Biggi
*Attorney, Agent, or Firm*—Lowe Hauptman Gopstein Gilman & Berner

[57] ABSTRACT

A connector assembly for mounting a coaxial plug to a coaxial cable includes a contacting ferrule which on one hand engages a cable conductor corrugated tube by means of threads, and on the other hand is connected to the housing of the coaxial plug. The connector is configured in such a manner that at its plug-side end the contacting ferrule constitutes a collet having resilient segments and evincing a conical compression surface which is subject to radial compression against the cable conductor corrugated tube by a plug-side, cooperating compression cone.

15 Claims, 3 Drawing Sheets

CONNECTOR ASSEMBLY FOR MOUNTING A COAXIAL PLUG TO A COAXIAL CABLE

FIELD OF THE INVENTION

The invention concerns a connector assembly for mounting a coaxial cable, and in particular, a contacting ferrule forming at its plug-side end a collet with conically bevelled resilient collet segments that can be radially compressed by a cooperating, plug-side compression cone against a corrugated conducting cable tube.

BACKGROUND OF THE INVENTION

Such coaxial cables with a corrugated outer conductor and, where called for, also a corrugated inner conductor inclusive in the appropriately assembled plug connection, are used in various sizes and outputs to transmit high-frequency power in mobile radio networks, broadcasting and TV facilities, radio relay systems, radar and satellite ground stations etc., and are used in large numbers worldwide.

Extraordinarily high quality of assembling is required for the connection between the conductor elements of the coaxial plug and the corrugated outer conductor or inner conductor of the coaxial cable, in order to meet the high electrical and mechanical requirements, especially regarding good contact and substantially loss-free transmission.

As regards the heretofore known connectors of the prior art, an exemplary connection of the outer conductor of the corrugated-jacket cable to the corresponding outer conductor of the coaxial plug is implemented by screwing a contacting ferrule in the form of a seating ferrule onto the outer cable conductor until it comes to rest against the cable plastic insulator. Next the projecting outer conducting tube of the corrugated jacket cable is outwardly flanged by about 90°, either manually or using cumbersome assembly devices, whereby said projecting outer conducting tube rests against the end surface of the screwed-on contacting ferrule.

The corrugated inner cable conducting tube is connected to the inner conductor of the plug in the same manner. For that purpose an inner-conductor contacting element is screwed into the inner cable conductor and thereupon a correspondingly projecting end of the inner cable conductor is flanged inwardly by about 45° on a conical portion of said inner-conductor contacting-element.

In both cases the flanging of the corrugated conducting cable tubes serves, on the one hand, to mechanically fix the contacting ferrule or the inner conductor contacting element to the corresponding cable conductor; on the other hand, flanging simultaneously forms the electrical contacting surface. This means that the electrical quality of the connection between the coaxial cable and the coaxial plug critically depends on the quality of flanging.

Depending on size, the assembling of such cable fittings requires 20 to 120 minutes of labor. Accordingly the said connection can only be carried at high costs in time and with other commensurate costs.

Lastly phase compensation frequently requires the disassembly of the assembled connection between the coaxial plug and the coaxial cable in order to shorten the cable for instance by 2–5 mm. This procedure is highly time-consuming as well, because the flanging must be bent back into its initial position in order that the contacting ferrule or the inner conductor contacting element can be unscrewed and the particular cable conductor can be trimmed. Thereupon the particular cable conductor must be flanged again. Additional cost in time is thus incurred.

Based on the above state of the art, the object of the invention is to design a connector assembly in such a manner that the cited drawbacks shall be eliminated, and that said connector assembly can easily and rapidly be assembled and disassembled without recourse to special tools, while meeting both electrical and mechanical requirements with components of simple construction.

SUMMARY OF THE INVENTION

The connector assembly of the invention comprises a contacting ferrule forming at its plug-side end a collet with resilient collet segments; the collet comprising a conical compression surface that can be radially compressed by a cooperating, plug-side compression cone against the corrugated conducting cable tube.

In this manner the contacting ferrule is affixed in exceedingly effective manner to the particular cable corrugated tube; at the same time the radially resilient collet segments assure a defined contact at the first corrugation or thread turn of the corrugated conducting cable tube. Such contact is significant at the cited location, and implemented by the invention in that the engaging component matched to the corrugated conducting-cable tube, for instance in the form of a cross-sectionally profiled thread, or a thread element of the contacting ferrule, can be rotated freely by 360° beyond the first pitch. Thereby the collet segments may evince resiliency and may be radially pressed together by being clamped together due to the action of the plug-side compression cone over a circumferential angle of 360°, and furthermore they may achieve thereby a defined contact.

The contacting ferrule of the invention preferably is made of a material, for instance silvered brass, offering good high-frequency conductivity.

The thread element or the cross-sectionally profiled thread of the contacting ferrule preferably runs over substantially the full length of said ferrule, including the collet. As already mentioned, the clamping segments of the collet are designed to make contact, when in their radially compressed position implemented by the plug-side compression cone, with the first corrugation turn of the corrugated conducting cable tube.

To allow or to favor said radial compression of the collet segments, the invention also calls for the collet being offset by an annular channel from the remaining portion of the contacting ferrule, said annular channel being of a larger depth than that the thread depths of the cross-sectionally profiled thread. Instead of using an annular channel, the resiliency of the individual collet segments also may be implemented in another manner, for instance, by means of a commensurately reduced wall thickness of the collet.

When the connector arrangement of the invention is used to assemble the outer conductor portion of the coaxial plug to the corrugated outer cable conductor tube, then the configuration shall be such that the cross-sectionally profiled thread of the contacting ferrule is an inside thread and that the conical compression surface of the collet is located at the collet's outer periphery.

In this case an advantageous embodiment of the invention provides that the plug-side compression cone be present at the inside circumferential surface of the plug housing forming the outer conductor element.

If, on the other hand, the connector arrangement of the invention is designed to assemble the inner conductor element of the coaxial plug to the corrugated inner cable conductor tube, then the cross-sectionally profiled thread of the contacting ferrule is an outer thread and the conical compression surface of the collet is located at the inside periphery of said collet.

In this case, the plug-side compression cone shall be present according to the invention at the outside surface of a contacting bolt, fitted with an outer thread element, which can be screwed by one of its ends into the contacting ferrule for the purpose of radially compressing the collet segments against the inner cable conductor tube, while comprising at its other end a cylindrical segment to link up in elastically clamping manner with the inner conductor element of the coaxial plug.

Lastly, the invention provides that the inner-conductor contacting ferrule comprise a stop in the form of an annular collar at its plug-side end, said collar being present at the free end of the collet and projecting outward. In this manner a specified position is implemented in a simple manner for the inner-conductor contacting ferrule relative to the inner cable conductor, without requiring special work on this inner cable conductor.

Overall, the invention allows reducing the hitherto known assembly times and costs up to 50% and more. It offers a further substantial advantage in that special tools are not needed to carry out assembly. Therefore assembly also can be carried out on site. Any phase compensation requiring cable shortening also can be carried out in a short time and in problem-free manner.

As already described, the contacting ferrule of the invention may be designed at its inner periphery not only as a cross-sectionally profiled thread, but also as a corrugated part matching the corrugated jacket of the outer cable conductor tube. Further advantages are achieved thereby in manufacture.

Thus the invention allows unusually advantageous simplifications in designing and building the plug components. Considerable savings are made possible relative to known connectors.

DESCRIPTION OF THE PREFERRED EMBODIMENT

Figure 1:
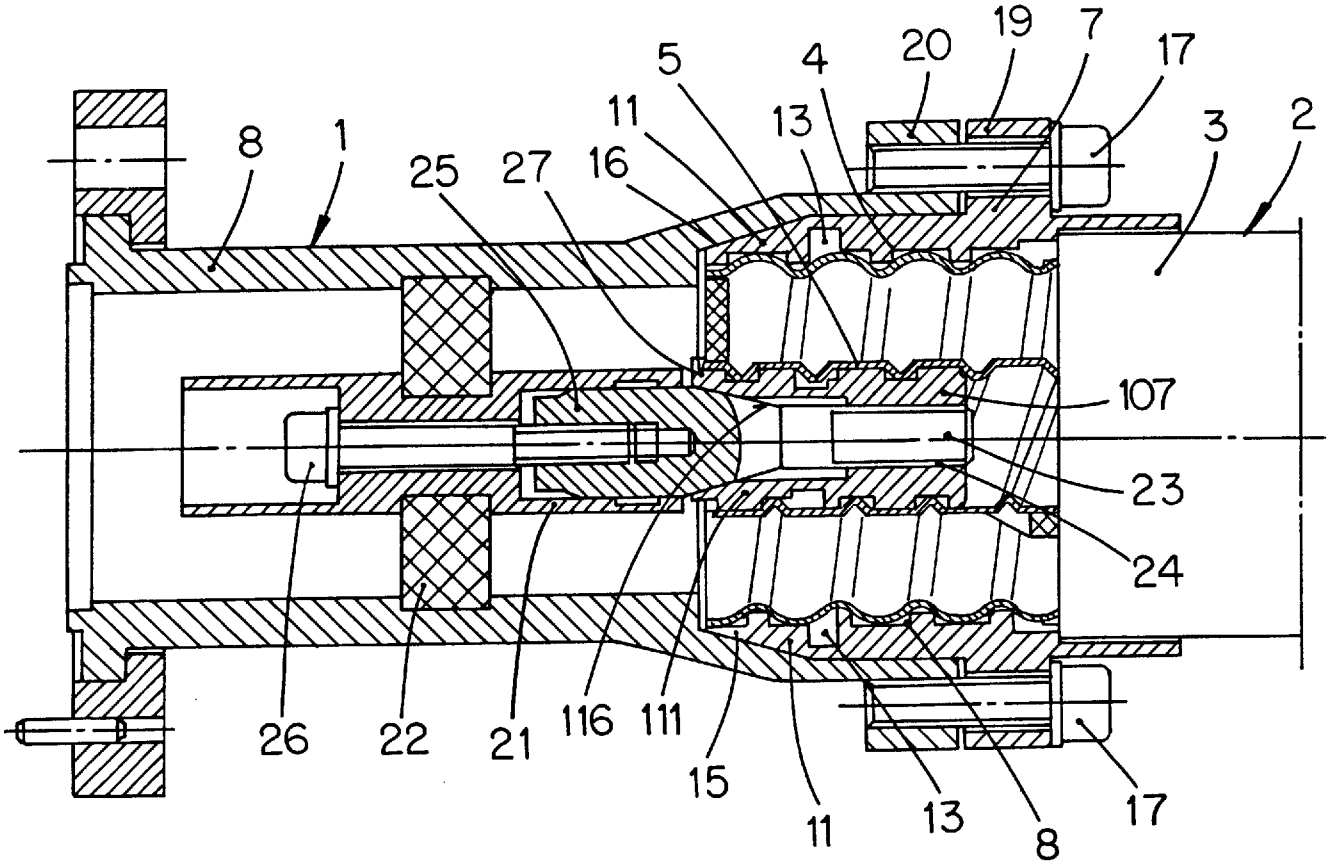
FIG. 1 is a schematic cross-section of the connector of the invention when assembled.

As shown by the drawing and in particular by FIG. 1, the shown connector is used to assemble a coaxial plug 1 to a coaxial cable 2. In the shown embodiment this coaxial cable 2 is a flexible copper corrugated jacketed cable and for that purpose comprises a outer cable conductor 4 in the form of a corrugated copper tube clad by a plastic jacket 3 and further an inner cable conductor 5, also in the form of a corrugated copper tube, centered by means of an insulator relative to said tube 4.

Figure 2:
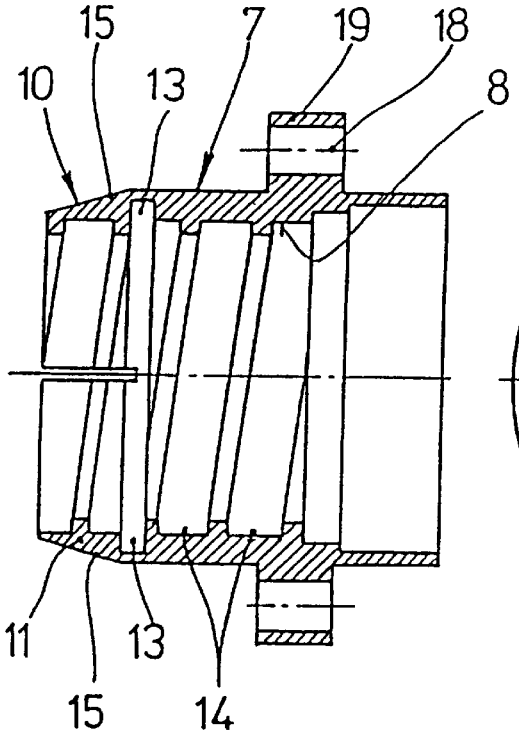
FIG. 2 is a section of the contacting ferrule for the outer cable conductor.
Figure 3:
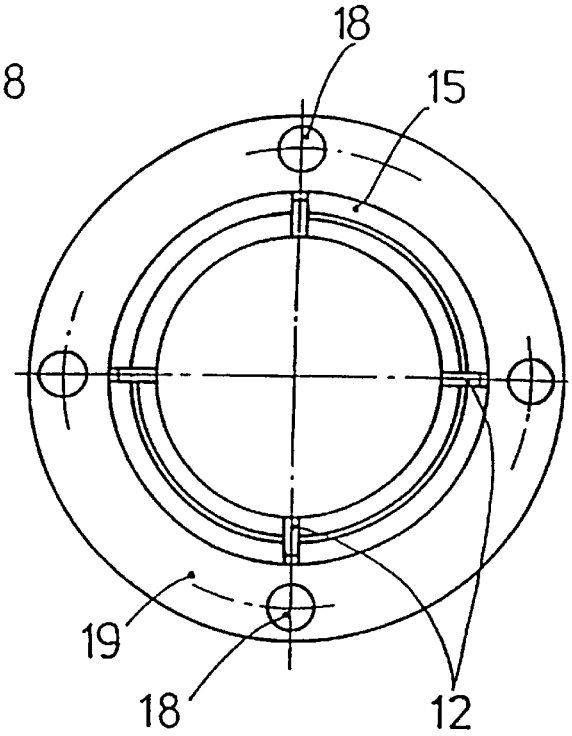
FIG. 3 is a front view of FIG. 2.
Figure 4:
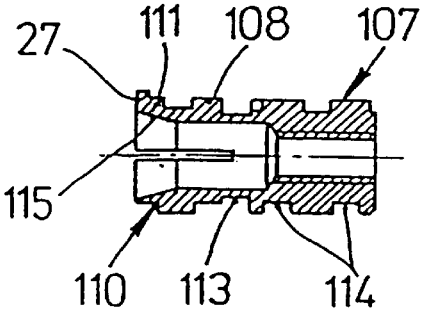
FIG. 4 is a section of the contacting ferrule for the inner cable conductor.
Figure 5:
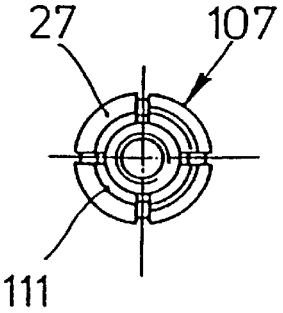
FIG. 5 shows the contacting ferrule of FIG. 4 in front view.

In order to assemble the corrugated outer cable conductor tube 4 to the corresponding outer conductor element of the coaxial plug 1, that is, to the plug housing 6, a contacting ferrule 7 is provided evincing the design shown in FIGS. 1, 2 and 3. This contacting ferrule 7 is fitted with a thread 8 in the form of an inner thread designed as a cross-sectionally profiled thread matching the thread of the outer cable conductor 4. This design allows screwing the thread 8 in simple manner onto the outer cable conductor 4, namely so that the free end of the outer cable conductor 4 shall be flush with the plug-side end of the contacting ferrule 7.

As further shown by the drawing, the contacting ferrule 7 further comprises at its plug-side end a collet 10 with resilient collet segments 11 formed in the shown embodiment by four mutually equidistant axial slits 12 in the collet 10. Obviously an arbitrary number of slits 12 also may be used.

As shown, the thread 8 of the contacting ferrule 7 runs over substantially the full ferrule length including the collet 10. To implement resiliency and clamping by the collet 10, it is designed to be offset from the remainder of the contacting ferrule 7 by an annular groove 13 evincing a larger radial depth than the depth of the threads 14 of the cross-sectionally profiled thread 8 (FIG. 2).

The collet 10, that is, its resilient segments 11, evinces at its outer periphery a conical compression surface 15. This compression surface 15 cooperates with a correspondingly conical compression cone 16 present at the inner periphery of the plug housing 6 forming the outer conductor element in such a manner that the resilient segments 11 of the collet 10 make defined contact by means of the radially clamped position caused by the plug-side compression cone 16, with the full first thread turn of the outer cable conductor 4, that is, over a peripheral angle of 360°.

This radially clamped configuration of the collet segments 11 will take place when the coaxial plug 1 is affixed to the coaxial cable 2. In general and for the embodiment shown, this procedure is implemented by a screw connection, screws 17 passing through corresponding boreholes 18 in an annular flange 19 of the outer-conductor contacting ferrule 7 and being screwed into threaded holes of an annular flange 20 at the coaxial plug 1.

In a similar appropriate manner, the described connector also is used to assemble the corrugated inner cable conductor tube 5 to the particular inner conductor element of the coaxial plug 1. In the shown embodiment, this plug inner conductor element is a resilient ferrule 21 kept centered in the coaxial plug 1 by an insulating disk 22 affixed to the plug housing 6.

An inner-conductor contacting ferrule 107 corresponding to the outer-conductor contacting ferrule 7 evinces a thread 108 which is an outer cross-sectionally profiled thread. Moreover the conical compression surface 115 of the collet 110 is located at the inner periphery of the collet 110. Similarly the collet 110, that is its resilient segments 111, is offset by an outer circumferential channel 113 from the remainder of the inner-conductor contacting ferrule 107. In this case as well the outer circumferential channel 113 evinces a depth larger than the thread depths 114 of the cross-sectionally profiled thread 108 in order to assure resiliency of the collet segments 111.

As clearly indicated in FIG. 1, the compression cone 116, cooperating with the inner conical compression surface 115 of the inner-conductor contacting ferrule 107, is present at the outer surface of contacting bolt 23. This contacting bolt 23 has an outer thread 24 for screwing into the inner-conductor contacting ferrule 107 for the purpose of radially pressing the resilient segments 111 of the collet 110 against the corrugated inner cable conductor 5. Moreover this contacting bolt 23 comprises a cylindrical segment 25 insertable into the matching resilient ferrule 21 for the purpose of coupling with the inner conductor of the coaxial plug 1 where it can be clamped in place by means of an inner-conductor central screw 26.

The contacting ferrule 107 is fitted at its plug-side end with a stop 27 to implement screwing the inner-conductor contacting ferrule 107 a given length into the corrugated inner cable conductor 5. The stop 27 assumes the form of an outwardly projecting annular collar and is present at the end of the collet 110.

Figure 6:
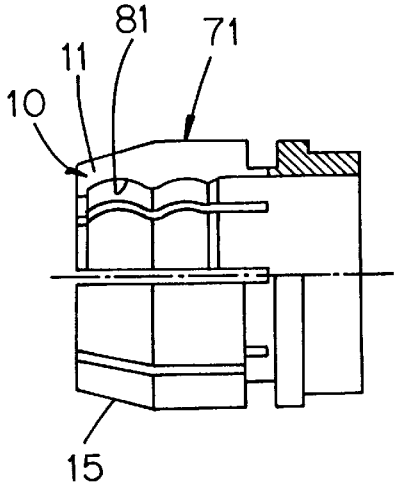
FIG. 6 is an embodiment variation of the contacting ferrule for the outer cable conductor shown in partial section and sideview.
Figure 7:
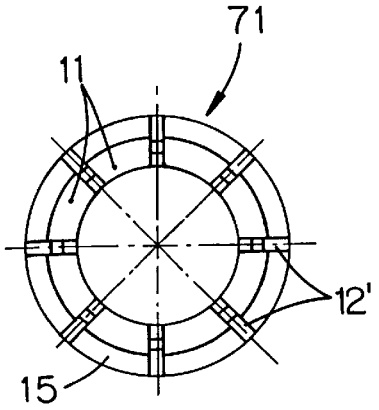
FIG. 7 is the contacting ferrule of FIG. 6 in front view.

A second embodiment of a contacting ferrule is shown in FIGS. 6 and 7, wherein the contacting ferrule 71 is fitted at its inner periphery not with a thread, but instead with an engagement element 81 in the form of a corrugation matching the corrugated tube of the outer cable conductor 4. This corrugated element 81 of the contacting ferrule 71 also is mounted or pulled in a simple and clamping manner on the corrugated jacket of the outer cable conductor 4, namely so that the free end of the outer cable conductor 4 shall terminate flush with the plug-side end of the contacting ferrule 71, as shown for the assembled configuration of the two above components in FIG. 8.

In this embodiment also the contacting ferrule 71 constitutes at its plug-side end the already mentioned collets having individually resilient segments 11. The collet segments 11 in this instance are formed by the collet 10 being fitted with eight equidistant axial slits 12'.

The corrugated element 81 of the contacting ferrule 71 runs over substantially the full length of the bush. Thereby the desired resiliency and clamping of the collet 10 is assured, at least beyond the complete full first corrugated turn of the cable-conductor corrugated tube 4. This feature is implemented in the manner already discussed in relation to the above described first embodiment, in that the conical compression surface 15 at the outside of the contacting ferrule 71 cooperates with the matching conical compression cone 16 of the plug housing 6.

Figure 8:
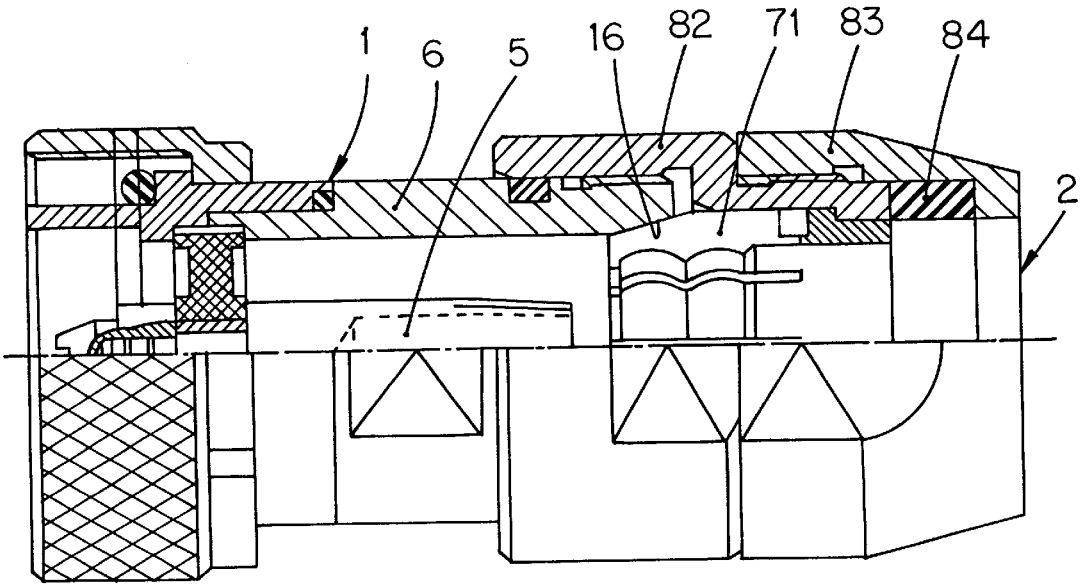
FIG. 8 is the contacting ferrule of FIG. 6 in the assembled state.

As shown by the assembled configuration of the described embodiment of FIG. 8, the shown connector basically corresponds to the embodiment of FIG. 1, however the coaxial plug 1 is not affixed to the coaxial cable 2 by screws, but instead a threaded ring 82 is provided which, as shown, is screwed onto the plug housing 6. Furthermore a locking screw 83 is provided and clamps the threaded ring with insertion of a seal 84.

Explicit reference is made here to the claims and the drawings as regards features of the invention not elucidated in detail.

What is claimed is:

1. A connecting device for electrically and mechanically coupling a coaxial plug having a plughead with a coaxial cable having a longitudinally extending conducting corrugated tube having first corrugations extending beyond an end face of a casing of the cable, the connecting device comprising a contact bush including a first end adapted to be connected to the corrugated tube of the cable and a second end adapted to be connected to the plughead, a stop adjacent the first end for receiving the end face, the second end including clamping tongs having resilient clamping segments for engaging the plughead, the clamping segments including a compressive cone having a compressive frusto-conical surface responsive to a force applied by the plug, the bush including second corrugations extending longitudinally from the second end substantially to the stop, the second corrugations mating with the first corrugations of the corrugated tube from the second end substantially to the stop, the compressive frusto-conical surface responding to the force applied by the plug for applying a radial force through the second corrugations against the first corrugations of the coaxial cable, the bush including a circular groove intersecting one of the corrugations, the groove being positioned, arranged and having a geometry to provide resilient, spring and clamping characteristics for the clamping tongs.

2. A connecting device according to claim 1 wherein the groove intersects the second corrugations.

3. The apparatus according to claim 2 wherein the groove offsets the tongs from the remainder of the bush.

4. The connection device of claim 3 wherein the coaxial plug includes a longitudinally extending interior conductor part and the cable includes a corrugated longitudinally extending interior conducting tube, the bush including a further conical compressive surface of the tongs located on the inside of said tongs.

5. The connecting device of claim 4 wherein the compressive cone is positioned to be responsive to insertion of the plug in the bush, the compressive cone being located outside of a contact bolt which can be screwed by an outer thread into the contact bush for pressing a clamping segment of the bush against the cable corrugated inner conducting tube, the contact bolt comprising a cylindrical section adapted to be coupled to the inner conductor part of the coaxial plug.

6. The connecting device of claim 4 wherein an interior conductor of the contact bush comprises at the first end a stop having an outwardly projecting annular collar.

7. The apparatus according to claim 1 wherein the groove offsets the tongs from the remainder of the bush.

8. The connecting device of claim 7 wherein the coaxial plug has an exterior conducting part and the cable conducting corrugated tube has an exterior surface, the conical compressive surface of the tongs being at an outer surface of said tongs adapted to be engaged by the plug exterior conducting part for establishing electrical and mechanical coupling of said exterior part and said exterior surfaces to each other.

9. The connecting device of claim 8 wherein the coaxial plug has a housing forming an outer conductor part of the plug, the housing including an inner frusto-conical surface, the compressive cone adapted to be engaged and urged inwardly by the frusto-conical surface of the coaxial plug.

10. A connector for connecting a coaxial plug having interior and exterior longitudinally extending coaxial conductors to a coaxial cable having interior and exterior coaxial conductors, the plug including at least one camming surface, at least one of the coaxial cable conductors being a cable having a first coaxial corrugated cylindrical surface extending beyond a tubular end face of the cable, the connector comprising:

a metal bush having spaced mutually insulated coaxial interior and exterior cylindrical segments, the interior and exterior segments being arranged to be electrically and mechanically connected to the interior and exterior conductors of the plug and cable so that (a) the plug fits into a second end of the segments, (b) the plug interior conductor is adapted to engage the bush interior segment, (c) the plug exterior conductor is adapted to engage the bush exterior segment, (d) the cable fits into a first end of the segments, (e) the cable interior conductor is adapted to engage the bush interior segment, and (f) the cable exterior conductor is adapted to engage the bush exterior segment; at least one of the segments including a second coaxial corrugated cylindrical surface adapted to mate with the first corrugated surface of the at least one conductor of the coaxial cable, the second corrugated surface extending longitudinally from the second end substantially to the stop, said at least one segment having a surface adapted to be engaged by the at least one camming surface and responding to a force applied by the camming surface for radially urging the second corrugated coaxial segment of the at least one surface into contact with the first corrugated surface of the at least one conductor, said at least one second corrugated coaxial cylindrical surface including a circumferential groove intercepting corrugations on the second corrugated surface, the groove being positioned, arranged and having a geometry to provide spring, resilient and clamping characteristics of the surface for radially urging the second corrugated coaxial surface of the at least one surface into contact with the first corrugated surface of the at least one conductor.

11. The connector device of claim 10 wherein the groove offsets the surface for radially urging the second corrugated coaxial surface of the at least one surface into contact with the first corrugated surface of the at least one conductor from the rest of the metal bush.

12. The connector device of claim 11 wherein the at least one coaxial cable conductor is the cable exterior conductor and the camming surface is on an interior surface of the plug exterior coaxial conductor, the bush exterior segment having an exterior surface adapted to mate with the plug interior surface, the bush exterior segment responding to engagement thereof by the plug camming surface to exert an inwardly directed radial force against the corrugated exterior tube of the coaxial cable, wherein the second corrugated surface is on the interior of the exterior bush segment.

13. The connector device of claim 12 wherein the camming surface includes a frusto-conical portion, and the bush surface mating with the camming surface is frusto-conical so that the camming surface applies longitudinal and radial forces to the bush exterior segment, the groove being positioned so it is responsive to the longitudinal and radial forces applied by the camming surface to the exterior segment.

14. The connector device of claim 12 wherein the at least one coaxial cable conductor is the cable interior conductor and the camming surface is on an exterior surface of the plug interior coaxial conductor, the bush interior segment having an interior surface adapted to mate with the plug exterior surface, the bush interior segment responding to engagement thereof by the plug camming surface to exert an outwardly directed radial force against the first corrugated surface, the first corrugated surface being on the interior tube of the coaxial cable.

15. The connector device of claim 14 wherein the camming surface includes a frusto-conical portion, and the bush surface mating with the camming surface is frusto-conical, so that the camming surface applies longitudinal and radial forces to the bush interior segment, the groove being positioned so it is responsive to the longitudinal and radial forces applied by the camming surface to the interior segment.

* * * * *